United States Patent [19]

Chatham et al.

[11] 3,970,224

[45] July 20, 1976

[54] SPOIL REMOVAL DEVICES FOR TUNNELLING MACHINES

[75] Inventors: Cyril Gordon Chatham, Harpenden; Kenneth Long, Petts Wood, both of England

[73] Assignee: National Research Development Corporation, London, England

[22] Filed: June 20, 1973

[21] Appl. No.: 371,878

[30] Foreign Application Priority Data

June 22, 1972 United Kingdom ..... 29348/72

[52] U.S. Cl. ..... 222/370; 61/84; 222/368

[51] Int. Cl.[2] ..... G01F 11/24

[58] Field of Search ..... 222/367–370; 61/84, 85; 175/94

[56] References Cited

UNITED STATES PATENTS

| | | | |
|---|---|---|---|
| 989,348 | 4/1911 | Haines | 222/370 X |
| 1,173,158 | 2/1916 | Arden | 61/84 UX |
| 2,669,441 | 2/1954 | Castanoli et al. | 61/84 X |
| 2,886,216 | 5/1959 | Öholm | 222/368 X |
| 2,955,808 | 10/1960 | Kandle | 175/94 X |
| 3,131,821 | 5/1964 | Tsujihata et al. | 222/368 X |

*Primary Examiner*—Robert B. Reeves
*Assistant Examiner*—Francis J. Bartuska
*Attorney, Agent, or Firm*—Cushman, Darby & Cushman

[57] ABSTRACT

For use with a tunnelling shield in which an excavating tool operates within a substantially sealed-off and pressurized region, a spoil-removal device for extracting spoil from the pressurized region comprises a cylindrical chamber which has an inlet port open to the pressurized region and a discharge port which is open to a position outside said region and a multi-compartment rotary member adapted to rotate in said chamber in sealed co-operation therewith, each compartment of the rotary member being arranged to pass said inlet port and said discharge port in turn and being arranged not to be open to both ports at the same time, each compartment being arranged to receive a charge of solid spoil when the compartment reaches the inlet port, the amount of the charge being governed by the angle of slide of the spoil, and to deliver the charge to said position outside the excavating region when the compartment reaches the discharge port, substantially each part of the compartment surface which supports the charge when in the vicinity of the discharge port being arranged to attain an angle to the horizontal which is generally in excess of said sliding angle of the spoil, whereby the compartment tends to empty itself while the compartment is open to the discharge port. The axis of rotation of the rotary member may be at right angles or parallel to the direction of the longitudinal axis of the tunnel being excavated. The device may include a receiver for receiving and supporting solid spoil in front of said inlet port.

5 Claims, 10 Drawing Figures

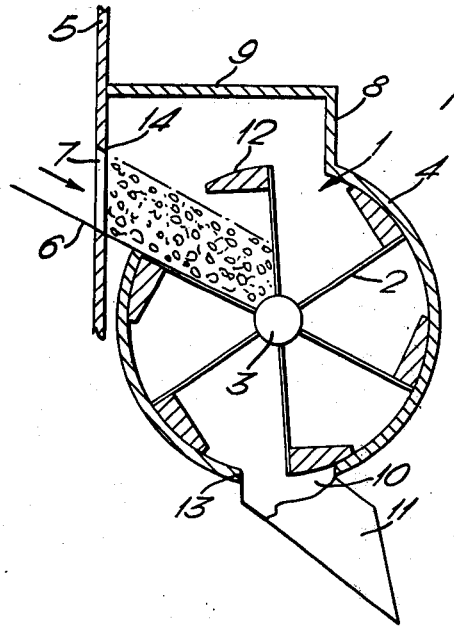
Fig. 1.
Fig. 2.
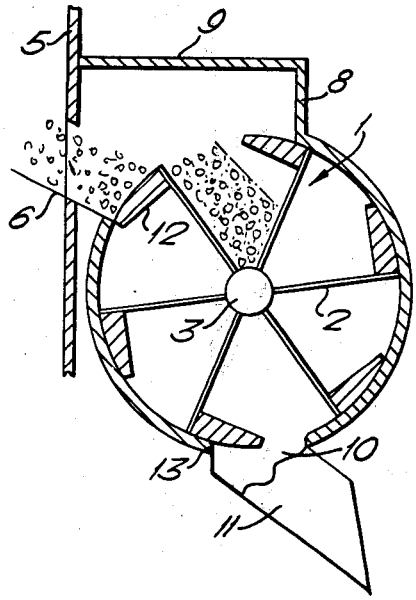
Fig. 3.
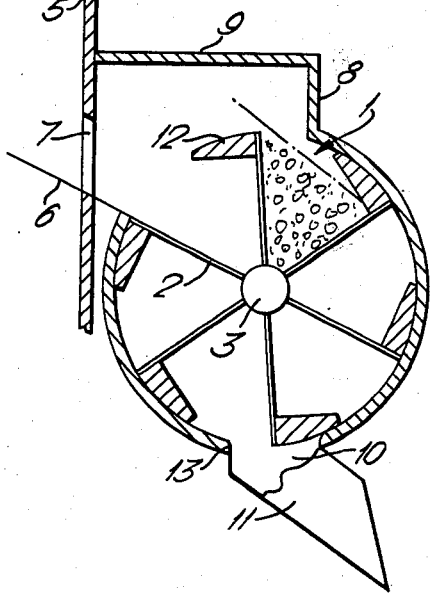

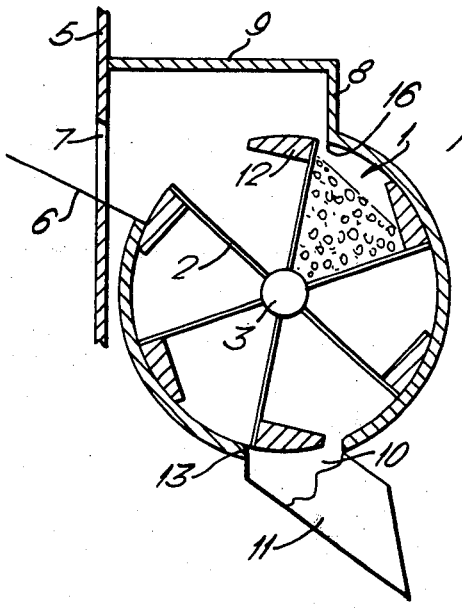
Fig. 4.
Fig. 5.
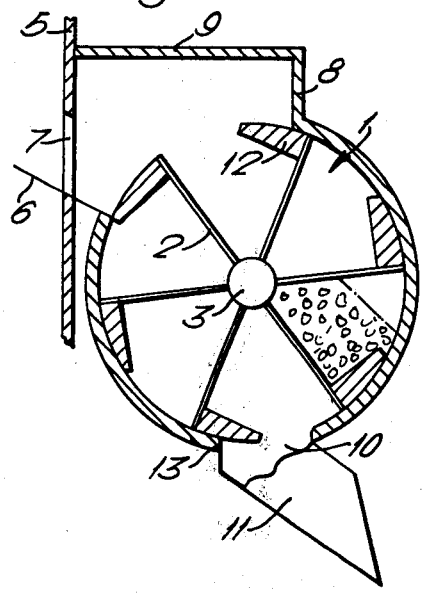
Fig. 6.
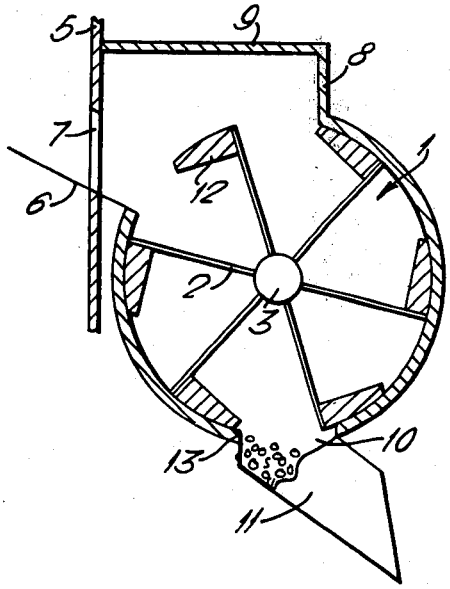

SPOIL REMOVAL DEVICES FOR TUNNELLING MACHINES

This invention relates to tunnelling apparatus and more particularly to spoil-removal devices for removal of spoil that has been excavated during a tunnelling operation. The invention is concerned with the type of tunnelling apparatus which incorporates a shield in which the excavating means operates within a substantially sealed-off pressurised region which is forward of a bulkhead in the shield. Such apparatus is described in British Patent Specification No. 1,083,322. In apparatus of this type, especially when used in tunnelling in strata containing lumps of hard material, such as large pebbles, as well as fluidisable material, difficulty is experienced in removing the lumps of hard material. In the sense that at least some of the material which is fluidisable may be equally as hard as the material of the lumps which cause difficulty, it is the size of the lumps that is the criterion. The fluidisable material may be pumped away reasonably simply by introducing liquid for the purpose or it may be fluidised and pumped away with liquid which is circulated for the purpose of pressurising the excavating region of the shield. However, larger pieces such as the lumps cannot be removed in this way and other arrangements must be made.

Pressurisation of the region forward of the bulkhead requires that the extracting means must be effectively sealed to retain the pressure. Since it is difficult to pass this larger spoil through the bulkhead other than by gravity because of the difficulty of sealing a normal conveyor, such as a screw auger type of conveyor, this spoil must be lifted to a suitable position within the pressurised region. However, difficulties arise in lifting which can be caused, for example, by the presence of the drive for the excavating means. Of course, if the excavating means is rotary, then means associated with the rotary means can be used to elevate the spoil for discharge into a hopper from which it can be passed to extracting means for passage past the bulkhead. Proposals have in fact been made for sealed excavating means involving two-stage devices and pusher-type reciprocating devices, as well as rotary paddle wheel devices, suitable for use with this type of shield. Of these known types, it is considered that a rotary device would be the most satisfactory when working with liquid pressurising medium but the known paddle wheel version has to be fed through a vertical chute and not only does this require a great deal of space but there is a further disadvantage. The spoil falls straight into the compartments formed between the paddles and, even if it were designed to deal with the largest lumps encountered, the compartments can easily fill, and there would be a distinct probability of pieces of spoil being caught by the paddles at the sealing point(s) of the paddles with the extractor walls; this, of course, can affect, and possibly break, the seal itself but it can also cause jamming of the extracting means.

It is an object of the present invention to provide an extracting means of the rotary type but in which the risk of undue wear and of jamming can be substantially obviated.

In accordance with the invention, a spoil removal device, for use with a tunnelling shield in which excavating means operates within a substantially seal-off, pressurised, region and wherein solid spoil has to be extracted from the pressurised region, includes a cylindrical chamber which has an inlet port open to the pressurised region and a discharge port open to a position outside the region, means being provided, if desired, for receiving and supporting solid spoil in front of said inlet port. It is to be understood that by the expression "sealed co-operation with said cylindrical member" we mean that the outer edges of the compartment walls are arranged to make sealing contact with the internal wall of the chamber and that at the same time the ends of the compartment walls make sealing contact with the respective end walls of the chamber, saving when passing the inlet port and the discharge port, the walls of the compartments being so shaped that no compartment is exposed to both inlet and discharge ports at the same time. By the term "solid spoil" we mean at least the larger lumps of spoil. The removal device also includes a multi-compartment rotary member in sealed co-operation with said cylindrical chamber and adapted to rotate therein, the compartments of the rotary member being arranged to pass said inlet port and said discharge port in turn and each compartment being arranged to receive a charge of solid spoil when the compartment reaches the inlet port, the amount of the charge being governed by the angle of slide of the solid spoil; the charge is delivered to the position outside the pressurised region when the compartment reaches the discharge port. Where air is used to pressurise the excavating region and no liquid is introduced it will be preferable that substantially all of the spoil entering each compartment at the inlet port should be ejected from the compartment during the time that the compartment is open to the discharge port.

Preferably it will be arranged that solid spoil is moved by rotation of the rotary member in such a way as normally to avoid interference of solid spoil between the rotary member and any part of the pressure seal between the rotary member and the cylindrical member at the inlet and discharge ports.

The axis of the rotary member may be arranged to be at any angle, or parallel, to the longitudinal axis of the tunnel; if it is at right angles a convenient arrangement is one wherein each said compartment can be considered to part of a segment of the imaginary cylinder represented by the rotary member, the leading wall of each compartment being provided with a projection which permits a predetermined charge of solid spoil to slide into the compartment while at the same time ensuring normally that the charge may slide within the compartment in such manner that the solid spoil moves away from the trailing and leading edges of the compartment in turn before said edges make contact with the respective seals at the inlet and discharge ports.

Where the axis of rotation of the rotary member is arranged to be parallel to the longitudinal axis of the tunnel another arrangement may be more convenient. Thus the rotary member may be in the form of a multi-start helical feed screw. By suitable shaping and disposition of inlet and discharge ports in the respective end walls of the cylindrical chamber and by selection of the helix angle of the blades of the feed screw it can then be arranged that there is substantially no direct connection between the inlet and discharge ports through any of the compartments. The number of blades will depend to an extent on the helix angle and on the capacity required of the device; the latter will be one factor governing the size of the compartment. When there is liquid pressurisation of the working face it is a feature of this invention that it can readily be arranged that the liquid which is discharged with the spoil from each compartment can be replaced in time for the compartment to be substantially filled again by the time that the leading edge of the input end of the compartment is about to reach the outlet port. In that way the introduction of air to the working space in front of the bulkhead from this cause is minimised, as is any major fluctuation of pressure in the liquid in front of the bulkhead. A deflection plate can be provided in a suitable feed hopper for the solid spoil, to assist in controlling the amount of each charge to the respective compartments, so that the charge is substantially dependent upon the angle of slide of the solid spoil. It may be necessary to make provision for some of the solid spoil to spill from part of the feed hopper to assist further in controlling the feed to the inlet port and to ensure that the charge of solid spoil in one compartment is clear of the trailing edge of the inlet port when the trailing edge of that compartment is in position to seal off the compartment.

Arrangements of spoil-removal devices in accordance with the invention will now be described by way of examples so that the invention will be more clearly understood.

FIGS. 1 to 6 illustrate diagrammatically one embodiment of the invention, namely a spoil-removal system which is more readily adaptable to the situation where the rotary member is preferred to operate with its axis at right angles to the axis of rotation of the rotary excavating means of a tunnelling apparatus of the kind described above.

An alternative construction of means for removing spoil is shown in FIGS. 7, 8, 9 and 10 of the drawings.

FIGS. 1 to 6 represent a series of depictions of the charging/discharging cycle of one compartment of the device. The device is intended for operation where the angle of repose of the solid spoil to be removed is about 35° and the sliding angle about 40° to the horizontal.

Figure 7:
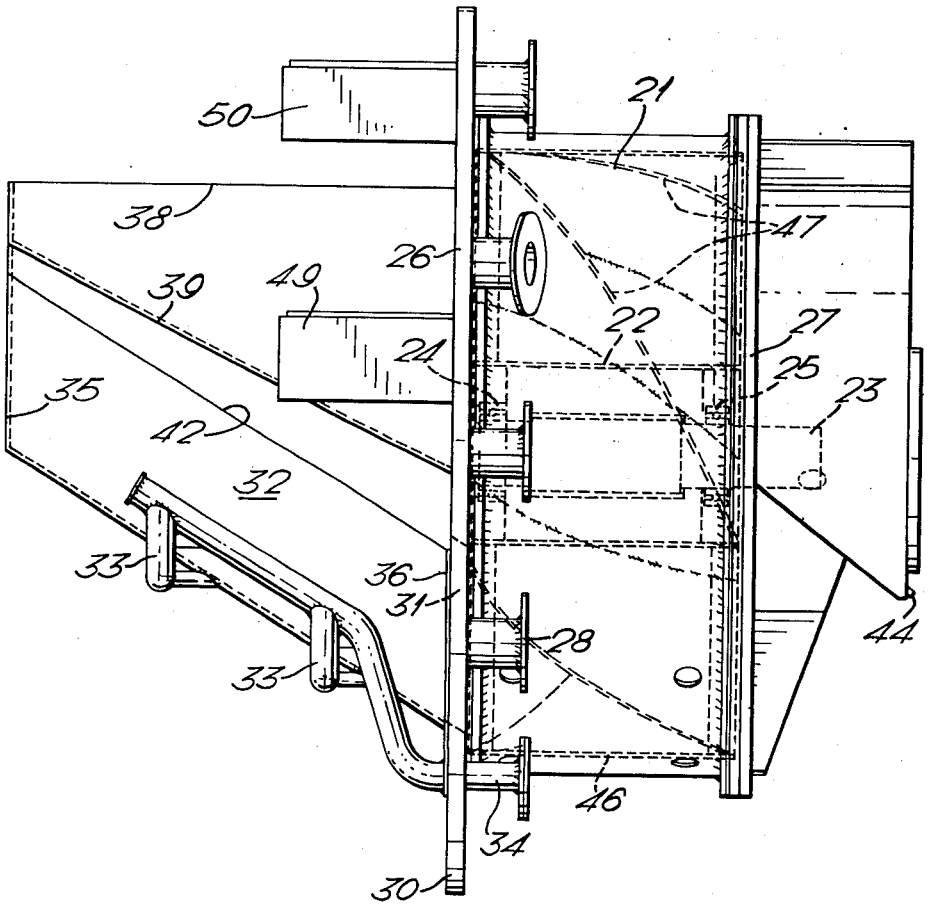
FIG. 7 is a side elevation of a spoil-removal device in which the spoil shifting means is arranged for rotation about an axis substantially parallel with the axis of the tunnelling apparatus.

Thus the device comprises a rotary member 1 with six equal size compartments formed by means of walls 2 radiating from a hub 3. The member 1 is arranged to rotate about the axis of the hub 3 so that the ends of the walls 2 seal against the interior wall of a part-cylindrical container 4. The seal is such as will be adequate to maintain the pressurisation of the environment in front of the bulkhead 5 of a tunnelling apparatus. A feeder chute 6 is associated with hopper means (not shown) so as to feed spoil to the compartments of the removal device. The angle of the chute 6 to the horizontal is arranged to be about 30° and its leading edge is sealed to the wall 4 at the inlet port 7; the inlet port 7 is further bounded, in sealed fashion, by the walls 8 and 9. The discharge port 10 is associated with the discharge chute 11 which is open to the atmosphere on the other side of the bulkhead 5.

End walls are provided for the container l4 against which the ends of the compartment walls 2 are in sealed contact.

Each wall 2 is provided with an end piece 12, the outer surface of which is shaped to match the curvature of the container. The inner surface, which is preferably flat, of the end piece is so arranged that when the wall 2 to which it is attached reaches the position where the free end of the end piece is approaching the trailing edge 13 of the discharge port, the angle of the inner wall will be greater than the angle of slide of the solid spoil; the result will be that all of the charge of the particular compartment will then have discharged before the trailing edge is reached. In that way there is little expectation that some of the spoil will interefere with the seal between the trailing edge of the discharge port and the trailing wall of the compartment.

The free end of the end piece 12 is positioned to provide an inlet to the compartment large enough to permit a standard charge of spoil as indicated in FIG. 1. There the spoil is shown only on the extractor side of the bulkhead but of course it will normally fill the space shown above the chute 6 on the working space side of the bulkhead. By suitable positioning of the top 14 of the inlet port 7, it is seen from FIG. 2 that spoil will move into an extractor compartment as soon as the end piece 12 moves further in a clockwise direction. However, by reason of the angle of repose of the spoil no further spoil will pass into the immediately previous compartment so that end piece 12 serves as a cut-off. Charging of the compartment proceeds as it becomes more open to receive spoil until the position is reached as indicated in FIG. 1; thereafter the end piece 12 starts to cut off the appropriate amount of charge. Following filling of a compartment, the charge slides within the compartment in such a manner that the solid spoil is maintained away from the trailing and leading edges of the compartment walls as these edges make contact with the respective seals and the inlet and discharge ports.

For clarity, the functioning of only one compartment will be described; thus, turning again to FIG. 2 and following through FIGS. 3 and 5 it is seen that, by reason of the angle of repose being exceeded by movement of the spoil as the extractor rotates, the charge moves in the compartment until the surface of the charge has dropped below the outer end of the trailing wall of the compartment. Then, at the state represented by FIG. 4, no spoil is present at the point 16 of sealing of the compartment wall and the trailing edge of the input port. There is, therefore, little danger of the extractor becoming jammed by spoil at this point.

As the extractor rotates further, through the position shown in FIG. 5, where, as can be observed, an effective seal is made for the particular compartment between the environments in front of and behind the bulkhead, the position shown in FIG. 6 is reached; in that position the inner wall of the end piece assumes a position such that it exceeds the angle of slide of the spoil and the charge is completely discharged by the time that this position is reached. By ensuring that the discharge chute 11 does not get blocked, it is certain then that spoil cannot jam the trailing wall of the compartment against the trailing edge 13 of the discharge port as referred to previously.

It is seen that the end pieces 12 provide effective sealing members in that they also each present a large surface area to the internal wall of the container 4.

It will be evident that arrangements may be made for adjustment of the position of the container relative to the inlet port in the bulkhead. Also that the height of the cut-off 14 of the inlet port may be varied to vary the amount of the charge entering each compartment of the extractor. Thus it may be desirable to adjust the angle of the chute 6 to allow for a change of angle of repose of the spoil to be removed. It is seen in FIG. 1 that the line of the chute 6 is carried on by that of the trailing wall of the extractor compartment at the point of cut-off by the end piece. It would appear to be desirable to maintain this alignment if the chute position or the extractor position is changed.

Although the design described with reference to FIGS. 1 to 6 provides a neat solution to the difficulty of removing spoil from a pressurised working region, it is such that the discharge point must always be below the intake point. Where the operating gear for the rotary excavator in front of the bulkhead has to penetrate the bulkhead itself, it is sometimes inconvenient or even impossible to provide sufficient height to permit the installation of such a means for withdrawing the spoil. For another thing, this entails raising the hopper and thereby losing capacity.

An alternative form of spoil remover will now be described with reference to FIGS. 7, 8, 9 and 10.

In these drawings, the device comprises a cylindrical body 21 which provides a seal around a bladed rotor 22. This rotor is mounted on a shaft 23 carried in bearings 24, 25 supported by a bulkhead end plate 26 and the back plate 27 respectively.

Figure 8:
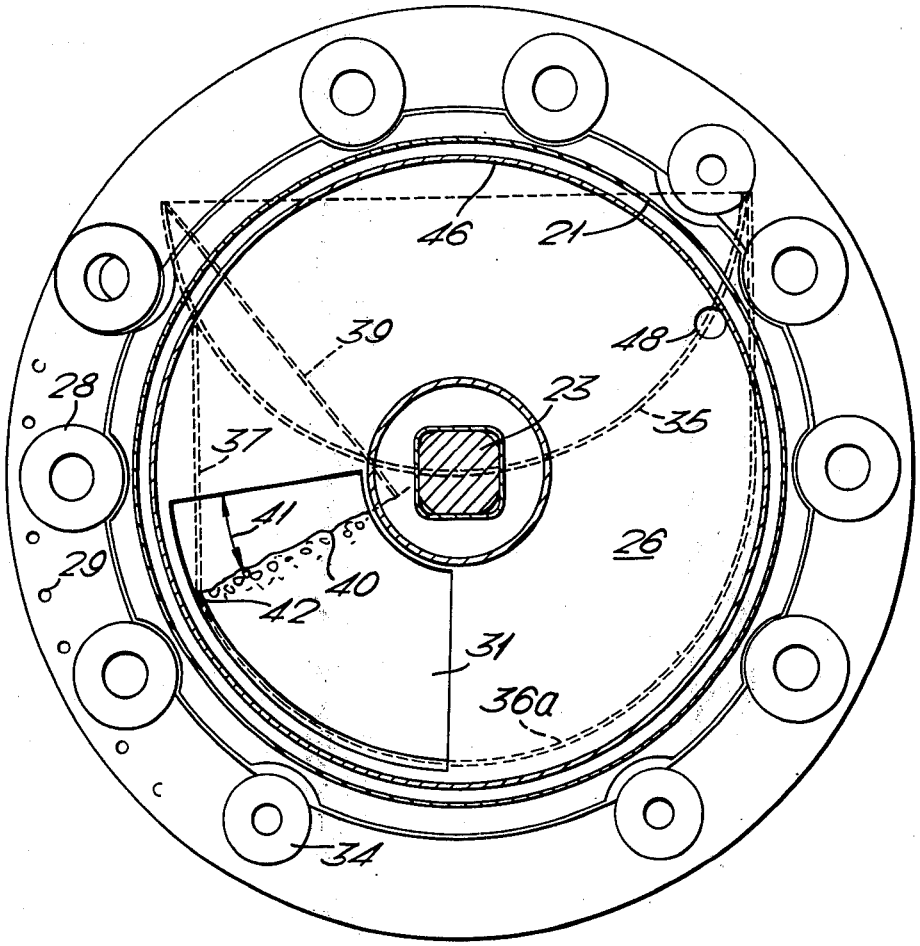
FIG. 8 is a section of FIG. 7.
Figure 9:
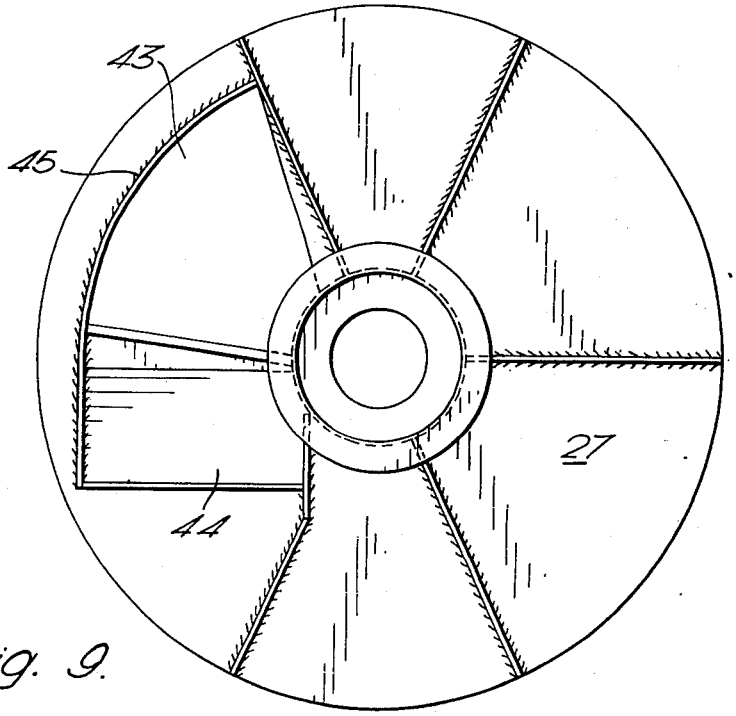
FIG. 9 is a detail of the device shown in FIG. 7.
Figure 10:
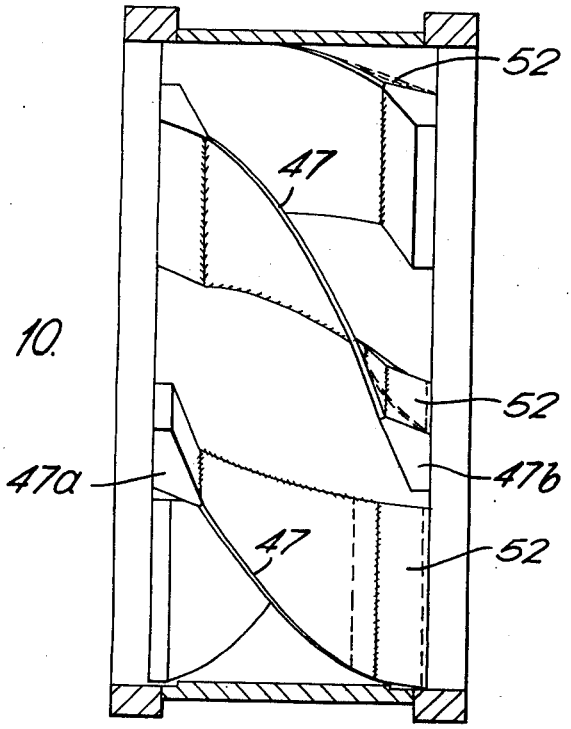
FIG. 10 is a side elevation of the rotor.

The inner face of the bulkhead end plate 26 is shown in greater clarity in FIG. 8. Holes 29, of which only a few are shown, are provided around the periphery for bolting the spoil remover to the bulkhead 30 (FIG. 7) of the tunnelling apparatus. The majority of flanged bosses (such as 34) are of no consequence to the spoil remover but are provided for purposes of carrying out other operations. An inlet port 31 is cut from the end plate and extends over approximately 80° of arc as shown. This opening co-operates with a hopper 32 which is provided with feed pipes 33 leading to one boss 34, through which liquid can be introduced if necessary to ease passage of spoil out of the hopper through the port 31.

The hopper 32 comprises a semi-circular end plate 35 and a curved base 36; the shape of the other end of the hopper is shown by the pair of curved lines 36*a*, a plate 37 being provided at one side. The angle of the base 36 of the hopper to the horizontal is arranged to be generally greater than the angle of slide of the solid being excavated. Spoil is fed into the hopper at the open upper part 38 and in order to prevent spoil clogging the whole of the port 31, a deflector plate 39 is provided. The surface of the spoil in one side of the hopper is caused by the lower edge of plate 39 to take up the positon indicated by the wavy line 40, the angle of this line to the horizontal being approximately the angle of response of the spoil. At the actual opening of the port 31 there is then a portion indicated by the angle line 41 which should be clear of spoil. If necessary the edge 42 of the hopper can be made adjustable, or can be cut down from an initial size, in order to adjust the extent of the clear zone 41.

The back plate 27 is provided with a cut-out 43 (FIG. 9) extending over about 60° of arc and this cut-out serves as the discharge port for spoil from each chamber of the rotor 22 as each chamber becomes open to the port. A diverting plate 44 at an angle greater than the sliding angle of the spoil is provided below the discharge port and a curved side plate 45 is provided to guide the emerging spoil to the plate 44.

The bladed rotor 22 operates within an inner cylindrical casing 46 which can be replaced if necessary, for example if its wear is excessive. There are five blades 47 equally spaced on the rotor and each blade is a simple uniform thickness helical plate welded at the base to the hub of the rotor. The sides of the blades are welded respectively to blocks 47*a* and 47*b* (FIG. 10) which house seals (not shown) for sealing the rotor compartments against the end plates of the extractor. A plate 52 is welded over the joint between each blade and seal block to ensure that the angle of all parts of the spoil support surface at the discharge end is maintained above the slide angle of the spoil.

The hub diameter is of course determined by the necessity to accommodate adequate bearings 24, 25 and the drive shaft 23. However, in an alternative, the hub size may be reduced if the rotor be driven on its outer diameter; there may then be difficulties over fabrication of the wheel. Only the illustrated version will be discussed herein.

The sizes of the inlet and discharge ports are determined by the throughput required and on the speed of rotation of the rotor; the sizes are also governed to a great extent by the size of spoil to be removed. It is assumed here that the illustrated opening angles are adequate and it is then obvious that anything less than a four-bladed rotor would not be possible since otherwise the criterion that the opening of any one compartment of the rotor to the inlet port must be closed before that compartment becomes open to the discharge port, would not be met. If there are more than five blades, then the smaller size of the compartments is a consideration and in most conditions five blades is probably a good choice. The rake of the blades is chosen so that the angle of the blade surface to the horizontal is approximately the sliding angle of the spoil when the blade is in the vicinity of the discharge port. In that way it is ensured that the spoil will tend to discharge from the compartment rather than stick to the blade surface. The reason for the plates 52 will be appreciated in this context. The rake of the blade at the outer diameter is obviously steeper than at the hub but a compromise can be reached.

In some cases of tunnelling apparatus with pressurised working zone, a thixotropic fluid is used to pressurise the system and this fluid has lubricating properties. Since in those cases this fluid will probably, if not essentially, also be passed through with the spoil there is every reason to assume that lower rake angles are permissible without loss of the facility to discharge the spoil rather than causing it to stick. After discharge of the spoil, the compartments have to be refilled with the fluid so as not to be empty when next reaching the inlet position. In that case the speed of rotation will need to be adjusted to enable the air trapped in the compartments to bleed off in order for the fluid to fill the compartments. Such expedients will be clear to those skilled in the art and do not require to be described in detail. However, the geometry of the rotor will be important. Thus, for instance, the length of thr rotor is related to the angular positions of the inlet and discharge ports and also dependent upon the rake of the blades; i.e. the steeper the rake, the shorter the rotor, and the shallower the rake, the longer the rotor. Also, the angular position of the inlet is chosen so that the trailing edge i.e. the edge that the blades reach last, is approximately horizontal, thus gaining the maximum advantage from the rake of the blades to cause spoil to slump deep along the rotor before the blade closes the compartment with resepct to the inlet.

The angular position of the leading edge of the inlet port is chosen to permit, as much as possible, sweeping of the bottom of the hopper by the blades of the rotor.

The angular position of the outlet is chosen such that its lower edge is approximately horizontal, to ensure that the rake of the blades is fully effective in discharging the spoil.

It will be observed that the relative position of the inlet and discharge ports in this embodiment is such that the spoil is in effect lifted on its passage through the rotor; this enables the hopper to have greater capacity by reaching to the bottom of the rotor. Also the receiving sump can be of reasonable proportions taking advantage of the extra depth available.

A inlet 48 is provided in the bulkhead and plate 26 to enable liquid to be introduced into each compartment as it becomes open to the discharge port. In this way it is possible to ensure that any spoil otherwise tending to stick to the rotor is washed out of the compartment. It may be necessary to extend the flushing inlet to form directional jets to aid the flushing operation. When thixotropic liquid is used for the tunnelling operation introduction of more of this liquid through the flushing inlet will serve also to ensure that the compartments are filled with the liquid on return to the charging position. Then the tendency to introduce atmospheric air to the working face in front of the bulkhead will be reduced. However, there will always be a certain amount of entrained air and self-actuating devices 49, 50 are provided in positions above points of entry of entrained air and automatic float controlled devices actuate valves to vent the collected air to the outer side of the bulkhead.

Although the spoil extractor shown in and described above with respect to FIGS. 7, 8, 9 and 10 is cylindrical there is reason to believe that this parallel configuration is not necessarily basic. Thus either the hub or the enclosing shell or both may be made frusto-conical in overall shape, the larger diameter(s) being towards the discharge end.

Other modifications and arrangements within the scope of the invention will be apparent to those skilled in the art.

We claim:

1. A spoil-removal device for use with a tunnelling shield in which excavating means operates within a substantially sealed-off and pressurised region and in which solid spoil has to be extracted from the excavating region, said spoil-removal device comprising:

a. a cylindrical chamber which has an inlet port open to the excavating region and a discharge port open to a position outside the region; and b. a multi-compartment rotary member adapted to rotate in said chamber in sealed co-operation therewith, each compartment of said rotary member being arranged to pass said inlet port and said discharge port in turn and being arranged not to be open to both ports at the same time, said rotary member having an axis of rotation parallel to the longitudinal axis of the tunnel being formed by the tunnelling shield and comprising a multi-bladed helical screw, the said compartments being formed between consecutive blades, the arrangement being such that a charge of solid spoil enters each compartment in turn through said inlet port, is passed along the compartment as the member rotates, and is discharged from the compartment through said discharge port at the other end of the device, the amount of the charge entering each compartment being governed by the angle of slide of the spoil, the compartment being shaped to maintain the charge away from the outer edges of the compartment before said edges reach the seal between the rotary member and the edge of the inlet port, and when located in the vicinity of the discharge port, the compartment being arranged to attain an angle to the horizontal which is generally in excess of the said sliding angle of the spoil, whereby the compartment tends to empty itself while the compartment is open to the discharge port.

2. A spoil-removal device as claimed in claim 1, wherein the means for supporting solid spoil in front of said inlet port comprises a hopper device the base of which is angled to exceed the angle of slide of the solid spoil being excavated.

3. A spoil-removal device as claimed in claim 2, wherein a deflector plate is provided within the hopper to ensure that the top surface of solid spoil in the vicinity of the inlet port to the device is below the top edge of the inlet port, whereby solid spoil tends to be kept away from the said top edge as the leading blade edge of each compartment reaches the said top edge.

4. A spoil-removal device as claimed in claim 1, wherein the rotary member and enveloping chamber are of frusto-conical shape, the larger diameter being towards the discharge end of the device.

5. A spoil-removal device as claimed in claim 1, wherein the lower edge of the discharge port is situated above the level of the lower edge of the inlet port.

* * * * *